US008807093B2

(12) United States Patent
Steinhafel

(10) Patent No.: US 8,807,093 B2
(45) Date of Patent: Aug. 19, 2014

(54) WATER HEATER WITH MULTIPLE HEAT EXCHANGING STACKS

(75) Inventor: Michael B. Steinhafel, Madison, WI (US)

(73) Assignee: Bock Water Heaters, Inc., Madison, WI (US)

( * ) Notice: Subject to any disclaimer, the term of this patent is extended or adjusted under 35 U.S.C. 154(b) by 433 days.

(21) Appl. No.: 13/111,670

(22) Filed: May 19, 2011

(65) Prior Publication Data

US 2012/0291719 A1 Nov. 22, 2012

(51) Int. Cl.
*F24H 1/18* (2006.01)
*F24H 1/00* (2006.01)

(52) U.S. Cl.
CPC ..... *F24H 1/00* (2013.01)
USPC ..... 122/18.1; 122/15.1; 122/135.3; 165/181

(58) Field of Classification Search
CPC ..... F28F 1/40
USPC ..... 122/15.1, 18.1, 32, 33, 31.1, 155.2, 122/18.3; 165/146, 183, 905, 179
See application file for complete search history.

(56) References Cited

U.S. PATENT DOCUMENTS

| | | | | |
|---|---|---|---|---|
| 3,349,754 | A * | 10/1967 | Bock | 122/13.01 |
| 4,408,661 | A * | 10/1983 | Eastman et al. | 165/164 |
| 5,069,169 | A * | 12/1991 | Maruko | 122/33 |
| 5,109,806 | A * | 5/1992 | Duggan et al. | 122/18.1 |
| 6,354,248 | B1 * | 3/2002 | Bourke | 122/18.31 |
| 6,612,267 | B1 * | 9/2003 | West | 122/13.3 |
| 6,622,786 | B1 * | 9/2003 | Calmidi et al. | 165/185 |
| 6,675,746 | B2 * | 1/2004 | Gerstmann et al. | 122/367.1 |
| 6,928,833 | B2 * | 8/2005 | Watanabe et al. | 62/515 |
| 6,945,197 | B2 * | 9/2005 | Ryoo | 122/15.1 |
| 6,957,629 | B1 * | 10/2005 | Steinhafel et al. | 122/155.2 |

(Continued)

FOREIGN PATENT DOCUMENTS

| | | | |
|---|---|---|---|
| DE | 3914746 | A1 | 11/1989 |
| EP | 0616173 | A2 | 9/1994 |
| EP | 0915304 | A2 | 5/1999 |
| EP | 1004833 | A2 | 5/2000 |
| EP | 1008819 | A2 | 6/2000 |

OTHER PUBLICATIONS

Bradford White Corporation brochure "Commercial Gas Ultra High Efficiency Water Heater."

(Continued)

*Primary Examiner* — Steven B McAllister
*Assistant Examiner* — Ko-Wei Lin
(74) *Attorney, Agent, or Firm* — Stiennon & Stiennon

(57) ABSTRACT

A water heater has a tank having an upper and a lower domes which are penetrated by tubular flues in a 1-1-5 arrangement of a first flue connected to a second flue which in turn is connected to tertiary condensing flues. A gas-fired burner on the upper dome fires into the first flue. Both the first and second flue have heat exchange capacity enhanced by a multiplicity of rectangular metal fins welded in a helical arrangement. Some or all of the fins in the first flue may be stainless steel, while the remaining fins may be a different material, such as mild steel. The first and second flues are arranged to remove approximately 82-89 percent of the heat generated by the burner with minimal or no formation of condensate. Approximately 5.5-9 percent of the heat generated by combustion in the burner is removed in third flues where condensation takes place.

20 Claims, 3 Drawing Sheets

(56) References Cited

U.S. PATENT DOCUMENTS

| | | | | |
|---|---|---|---|---|
| 7,290,503 | B2 * | 11/2007 | Missoum et al. | 122/18.1 |
| 7,413,004 | B2 * | 8/2008 | Okonski et al. | 165/163 |
| 7,559,293 | B2 | 7/2009 | Gordon et al. | |
| 7,836,856 | B2 * | 11/2010 | Mullen et al. | 122/155.2 |
| 8,327,810 | B2 * | 12/2012 | Arnold et al. | 122/18.1 |
| 8,418,753 | B2 * | 4/2013 | Hirokawa et al. | 165/177 |
| 8,550,147 | B2 * | 10/2013 | Lansinger | 165/41 |
| 2002/0050342 | A1 * | 5/2002 | Gerstmann et al. | 165/109.1 |
| 2005/0139172 | A1 * | 6/2005 | Ryoo | 122/31.1 |
| 2006/0059946 | A1 * | 3/2006 | Watanabe | 62/515 |
| 2008/0216772 | A1 * | 9/2008 | Gordon et al. | 122/18.3 |
| 2009/0294112 | A1 * | 12/2009 | Reifel et al. | 165/179 |
| 2009/0301406 | A1 * | 12/2009 | Ritsema et al. | 122/13.01 |

OTHER PUBLICATIONS

Bock Water Heaters, Inc. brochure "Multi-Flue."

Web page, "Strength—Max. service temperature", <http://www-materials.eng.cam.ac.uk/mpsite/interactive_charts/strength-temp/NS6Chart.html>, accessed Apr. 11, 2014.

Web page, "The Engineering ToolBox", <www.EngineeringToolBox.com>, Engineering Materials.

Web page, "Copper Alloys—Copper Nickel Alloys", <http://www.nickel-alloys.net/copper_nickel_alloys.html>, accessed Apr. 11, 2014.

* cited by examiner

3000°F
Combustion Gas Temp.
100°F
0
100%
Heat Transferred
0%
VENT
50
46
37
DRAIN
48
150°-100°F
9-5.5%
44
400°-150°F
11-4.5%
42
62
40
38
750°-300°F
39
71-84%
58
56
34
2000°F
3000°F
22
74
PID
Combuster Motor
72
70
36
20

WATER HEATER WITH MULTIPLE HEAT EXCHANGING STACKS

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to water heaters in general, and more particularly to water heaters with multi-flues, at least one of which is condensing.

Heat exchange between a liquid and a gas is a process which has many industrial and domestic applications. Perhaps one of the most widely used applications of heat exchange between a gas and a liquid is in heating water. Typically a water heater has a tank which holds the water to be heated, and a burner producing combustion gases. The water is heated by the combustion of fuel with air in the burner to produce combustion gases which heat the water in the tank by passing through one or more flues or tubes which extend through the water tank. Two considerations which are paramount in the design of a water heater are durability and efficiency. Ever since the early 1970s there has been a heightened awareness of the importance of efficiency for cost, environmental, and geopolitical reasons. Efficiency is a measure of how effectively the heat energy present in the fuel is transferred to the water contained within the water heater tank.

The combustion gases pass through the flues, exchanging heat with the walls of the flues and thus the water contained within the water tank. It has long been known that internal baffles within a flue can increase heat transfer between the flue gases and the water within the water tank. The baffles create turbulent flow which mixes the combustion gases within the flue, bringing more of the flue gases into contact with the flue wall which transfers heat to the water. Further, if the baffles are welded to the wall of the flue, heat is conducted from the baffles to the wall of the flue.

As efforts are made to increase efficiency, i.e. the percentage of the combustion energy which is transferred to the hot water, at some point increased efficiency requires utilizing heat released by condensing water vapor which is produced by combustion of the hydrogen contained in the fuel. Because the latent heat of water vapor is relatively high, approximately a thousand BTUs per pound, a relatively large amount of the energy of combustion is contained in the latent heat of evaporation of the water vapor (i.e., in the steam), formed as a combustion byproduct. A pound of natural gas when combusted with dry air will produce about 2¼ pounds of water. A pound of heating oil will produce approximately 1.4 pounds of water. When the relative heating values of the fuels are taken into account approximately 7 percent of the heat of combustion of number 2 oil is contained in the latent heat of the water produced during combustion, and approximately 10 percent of the heat of combustion of natural gas is contained in the latent heat of the water produced during combustion. Therefore, a number of gas water heaters have been developed which employ heat exchangers which condense at least some of the water contained in the flue gases. Such systems have been described as having efficiencies of 90 to 96 percent.

Condensing heat exchangers must be arranged to drain downwardly, and must be designed to overcome the corrosion potential of liquid water, which is often contaminated by corrosive constituents in the intake air or corrosive products of combustion.

What is needed is a water heater which utilizes the heat transfer capabilities of a finned flue, but achieves greater efficiencies by also utilizing a condensing flue.

SUMMARY OF THE INVENTION

The water heater of this invention has a cylindrical tank which extends between a circular upper dome and a circular lower dome. The tank is penetrated by seven tubular flues which extend between the upper and lower domes and have a 1-1-5 arrangement of a first flue connected to a second flue which in turn is connected to five tertiary condensing flues. A gas-fired burner of approximately 100,000 to 500,000 BTUs per hour is mounted on the upper dome to fire into the first flue. The heat exchange capacity of the first flue is enhanced by a multiplicity of rectangular metal fins which are welded in a helical arrangement on the inside of the vertical flue. The first flue is connected to a second flue by a junction box mounted on the lower dome so the combustion gases are transferred from the first flue to flow upwardly through the second flue which is also lined with a multiplicity of rectangular metal fins which are welded in a helical arrangement on the inside of the second flue. A second junction box is mounted on the upper dome so that combustion gases from the second flue are transferred through a plenum to five tertiary glass lined condensing flues. The first and second flues are arranged to remove approximately 82-89 percent of the heat generated by combustion in the burner with minimal or no formation of condensate. Approximately a further 5.5-9 percent of the heat generated by combustion in the burner is removed in third or tertiary flues where condensation takes place. The condensate formed in the third flues drains downwardly along the tertiary flue walls, into a third junction box which connects the third flue to a condensate drain in the vent tubes. The heat exchange in the first and second flues is tailored by the arrangement of fins to accomplish a removal without condensation. The five tertiary flues accomplish condensing heat exchange utilizing cold drawn mild steel tubes with a stainless steel baffle plate suspended along the length of the tertiary tubes. The fins welded to the first flue are at least in the upper part of the flue exposed directly to the combustion gas from the burner and so are manufactured of heat resistant alloy such as 309S stainless steel which has good strength and oxidation resistance in continuous service temperatures up to 2000° F. (1093° C.).

It is an object of the present invention to provide a water heater which combines the advantages of low flow resistance flues with a condensing heat exchanger.

It is another object of the present invention to provide a water heater wherein the heat transfer in the vertical flues can readily be adjusted by changing the number and placement of the fins in the flues.

It is yet another object of the present invention to provide commercial water heating in the 150,000 to 500,000 BTU/hr class.

Further objects, features and advantages of the invention will be apparent from the following detailed description when taken in conjunction with the accompanying drawings.

DESCRIPTION OF THE PREFERRED EMBODIMENTS

Figure 1:
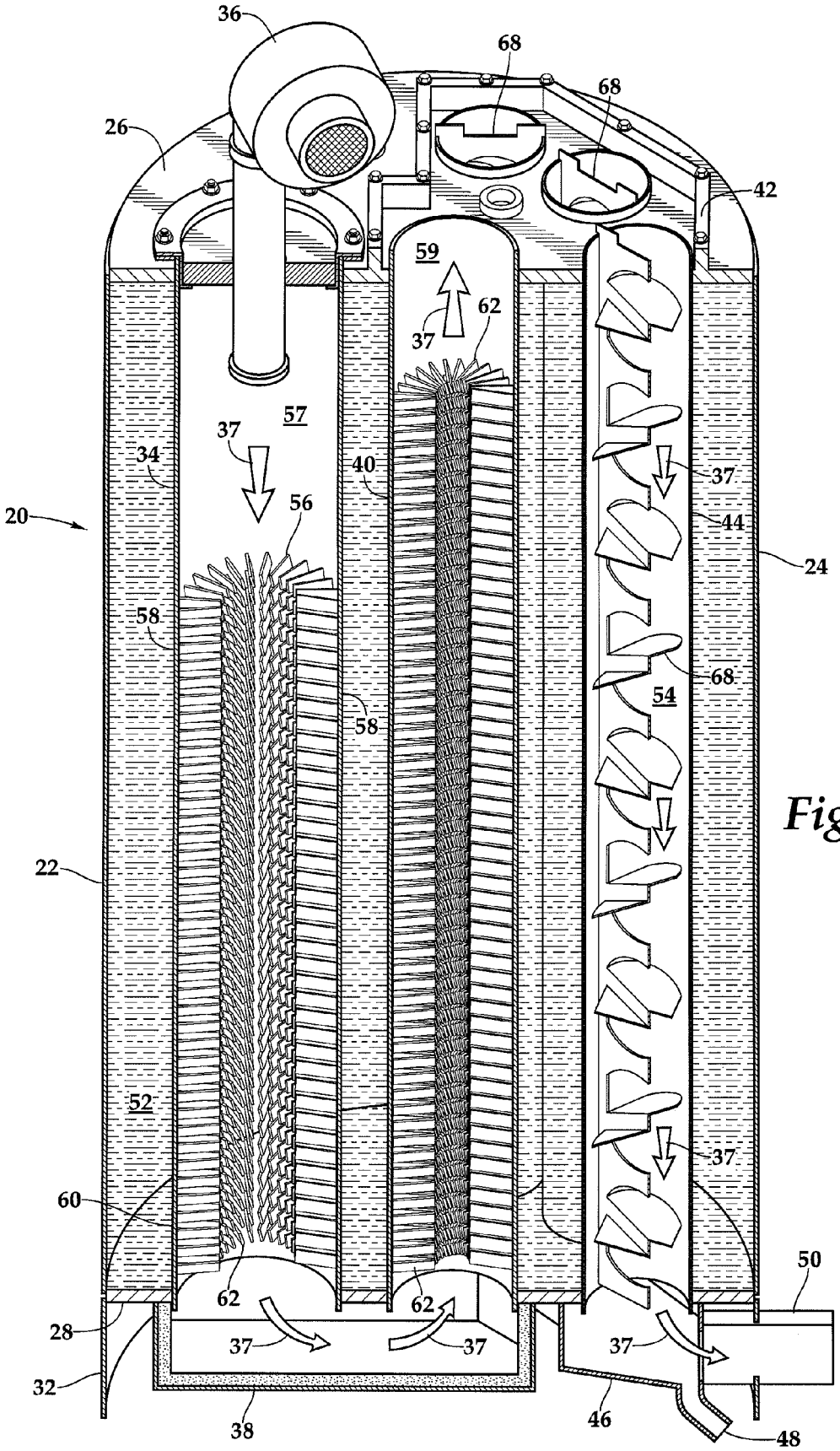
FIG. 1 is a schematic cross-sectional view of the condensing water heater of this invention.
Figure 2:
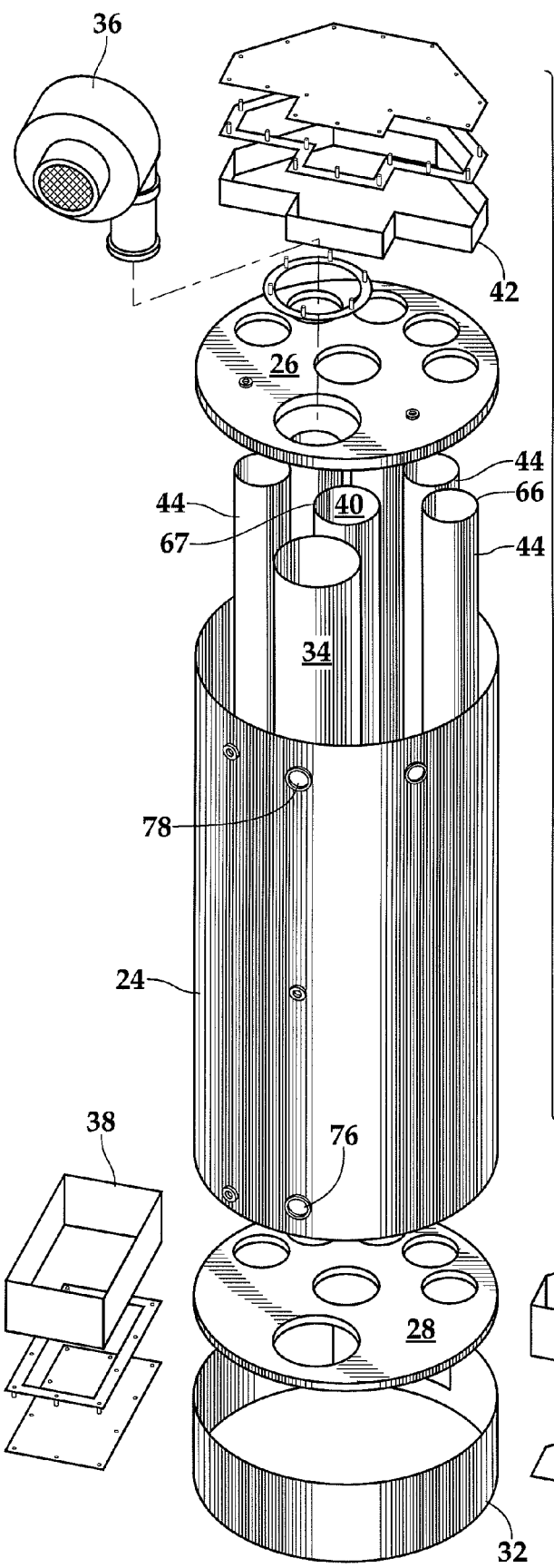
FIG. 2 is a top view of the condensing water heater of FIG. 1 showing five tertiary condensing flues.
Figure 2:
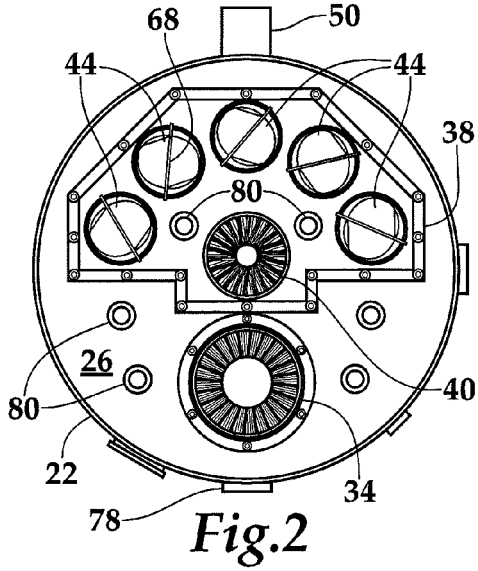

Referring more particularly to FIGS. 1-5 wherein like numbers refer to similar parts, a water heater 20 is shown exploded in FIG. 2, and schematically in FIG. 1. The water heater has a tank 22 formed of a mild steel cylindrical outer shell 24 to which are welded two circular domes, comprising an upper dome 26, and a lower dome 28. Mounted below the water tank 22 as a downward continuation of the outer shell is a cylindrical stand 32. Seven cylindrical flues or heat exchanging pipes 34, 40, and 44 are arranged between the upper dome 26 and the lower dome 28 such that the axes of the flues are parallel to an axis defined by the outer shell 24 of the tank 22. A power burner 36 is mounted to the first flue and is fired downwardly into first flue 34 from the upper dome 26. The burner 36 supplies approximately 20%-30% excess air and natural gas, which are burnt to form combustion gases 37, indicated in FIG. 1, which flow downwardly through the first flue 34. The combustion gases are transferred via a junction box 38 mounted on the lower dome 28 to a second flue 40. The combustion gases travel in the second flue 40 upwardly through the water tank 22 to the upper dome 26, where they are transferred by a second junction box 42 mounted to the upper dome 26 to five tertiary and final flues 44 in which the combustion gases can travel downwardly to a third junction box 46 which connects the third flue to a condensate drain 48 and an exhaust vent 50.

As the combustion gases travel from the power burner 36 through a volume of water 52 contained within the tank 22, the combustion gases exchange heat with the walls of the three different flue types 34, 40, 44. The first flue 34 has fins 56 welded to the inner surface 57 of the flue and is typically greater in diameter than the second flue 40, which also has fins 62 welded to its inner surface 59, and which in turn is typically greater in diameter than the third flues 44. For example, in a 130 gallon water heater which is fired at a rate of up to 500,000 BTUs per hour, the first flue 34 may be 8 inches in diameter, the second flue in the same water heater may be 6 inches in diameter, and the third flue may be 5 inches in diameter. In the arrangement of the first, second and third flues, 34, 40, 44 it is desirable that the third and final flues 44 be arranged so that the combustion gases flow downwardly, so that condensation which forms on the walls 54 and within the flow of combustion gases moves downwardly to the condensate drain 48.

As hot combustion gases flow down through the first flue 34, the flow of hot combustion gases is mixed and impeded by a multiplicity of discrete high temperature resistant metals fins 56 which form the fins within at least the upper part 58 of the first flue 34 and so make up at least the upper half of fins 56 in the first flue. A suitable material is type 309S stainless steel which can be used continuously at temperatures up to about 2000° F. Each fin 56 has a generally rectangular plan, i.e., two long sides and two short sides, and has a thickness of, for example, ⅛ or ¼ inches, and extends radially inwardly substantially toward the axis of the first cylindrical flue 34. The location of the fins along the first flue 34 is shown in FIG. 1. The design of the finned flues and the placement of the fins forming the heat exchanger is described more completely in U.S. Pat. No. 6,957,629 which issued on Oct. 25, 2005, and in U.S. Pat. No. 4,761,532 which issued on Aug. 2, 1988, the disclosures of both of which are incorporated herein by reference. It should be noted that to weld stainless steel fins to the mild steel tubes of the flue 34, removal of the oxide layer, clamping pressure, current, and voltage must be adjusted to account for the changes in material properties.

Fins 62 arranged in the lower portion 60 of the first flue 34 and within the second flue 40 may be formed of mild steel to the extent the temperature of the gases has fallen sufficiently so as not to degrade the mild steel fins over time i.e., below about 1000° F. (540° C.) where mild steel is suitable for continuous service. The junction box 38 may be welded to the lower dome 28 and is lined with vacuum formed ceramic fiber material 39 to minimize the heat loss from the junction box. Examples of a suitable material for lining the junction box 38 are materials with continuous use temperatures of over 2000° F. and composed of over 90% $Al_2O_3$ and $SiO_2$ with R values of 1-2 in the range of 2000° F. to 600° F.

The second flue 40 extends upwardly through the tank 22 and is of a smaller diameter than the first flue, because of the greatly reduced volume of combustion gases as the result of the falling temperature. When absolute temperature falls by more than half, the cross-sectional area of the second flue can also decrease to about half that of the first flue 34. The heat exchange capability of the second flue 40 is selected by modifying the arrangement of the fins 62 and the percentage of the axial length of the second flue which is covered by fins. The heat exchange capacity of the second flue 40 is matched to the heat exchange capacity of the first flue 34 such that the flue gases exiting the second flue have a temperature somewhat above the dew point i.e. the point at which water begins to condense out of the combustion gases. In this way the presence of liquid water in the second flue 40 with the attendant problem of corrosion is substantially controlled or eliminated.

The five tertiary flues 44 are designed to achieve heat recovery by condensing water vapor in the combustion gases 37. As shown in FIG. 1, the combustion gases 37 from the second flue 40 empty into the shallow junction box 42 welded to the upper dome 28 of the tank 22 as shown in FIG. 2. The five tertiary flues 44 have their combustion gas receiving ends 66 also extending into the junction box 42. The tertiary flues 44 are arranged equidistant from the secondary flue 40 so that the plenum formed by the junction box 42 evenly distributes the combustion gases 37 to each of the five tertiary flues. The ends or openings 66 of the tertiary cylindrical flues 44 are equally spaced along an arc of a circle centered on the upper end 67 of the second cylindrical flue. The tertiary flues 44 are designed to have identical or nearly identical flow characteristics so that the flow of combustion gases 37 approximates an even split between all the tertiary flues. Because liquid water is present in the condensing tertiary flues 44, the flues are lined with glass i.e. a porcelain enamel coating, and the tertiary flues are preferably formed of cold drawn mild steel. Glass lining better adheres to cold drawn mild steel. In the tertiary flues 44 stainless steel baffles 68 are hung from the gas receiving ends 66 of the tertiary flues as shown in FIG. 1 to increase turbulence within the tertiary flues. The baffles extend axially within the tertiary flues and have regular radially extending projections which deflect the flow casing turbulence.

The tertiary flues 44 empty into a third junction box 46 which may be constructed of enamel coated steel or uncoated stainless steel welded to the lower dome 28 of the tank 22, or can be constructed of plastic or other moderate temperature material which is compatible with liquid water. The third junction box 46 slopes downwardly and outwardly of the tank 22 such that condensation water drains to the drain 48. The drain 48 typically is connected to a floor drain through a water lock (not shown) which allows only water and not combustion gases to pass. The gases proceed through an exhaust vent 50 then pass up a stack (not shown) and exit the building to prevent the buildup of oxygen depleted air, carbon dioxide, and humidity inside the building housing the water heater 20. Because the power burner 36 supplies the combustion gases under pressure it is not necessary to use an exhaust fan for the combustion gases.

As previously discussed, for a natural gas fired water heater, approximately 10 percent of the total heat produced by combustion is contained in the latent heat of the water vapor produced during combustion.

Figure 5:
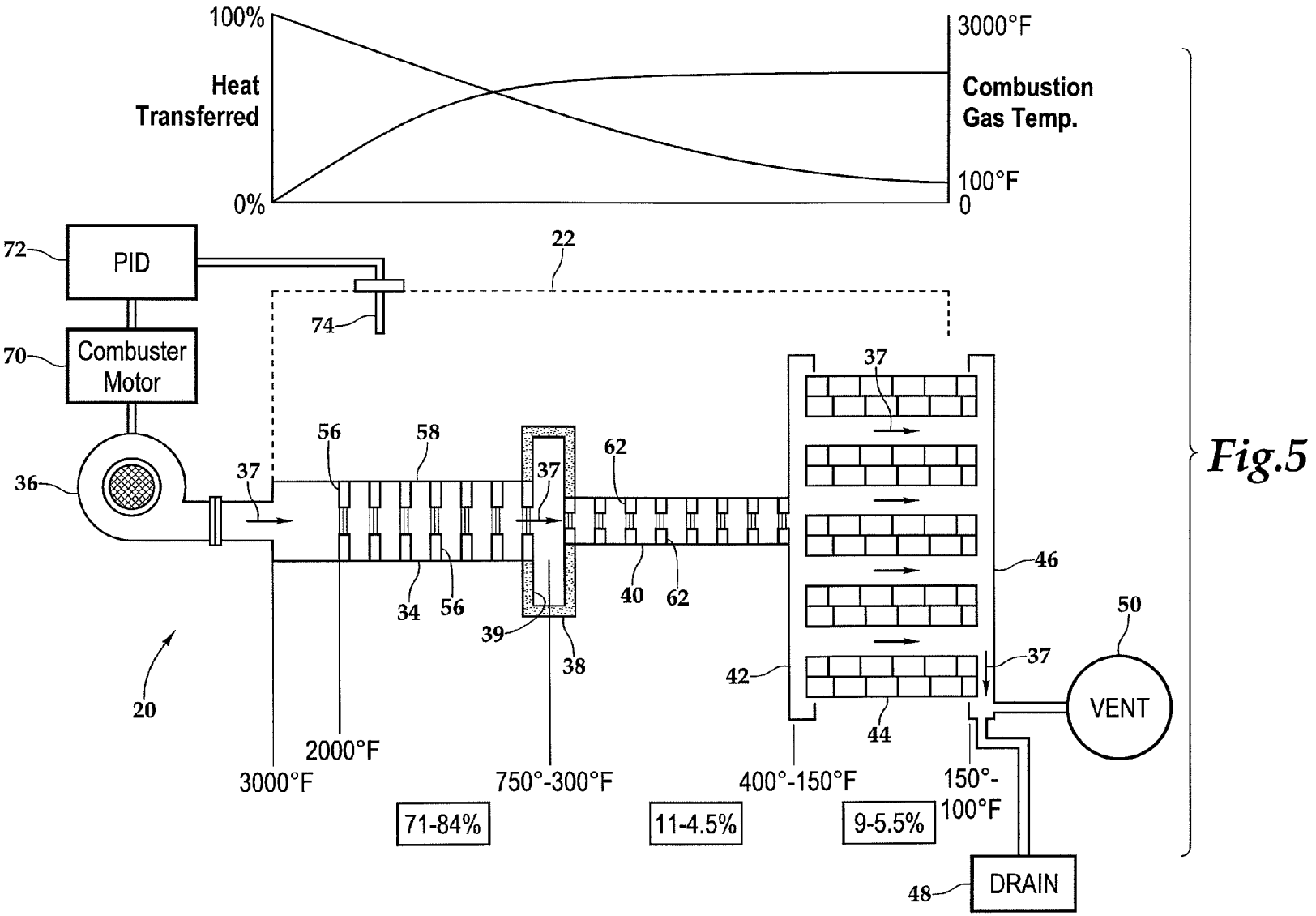
FIG. 5 is a illustrative diagrammatic view of the operation of the water heater of FIG. 1

The operational arrangement of the principal components of the water heater 20 are shown arranged schematically in FIG. 5 to illustrate the operational design parameters for the water heater. Beginning on the left side of FIG. 5 the power burner 36 is shown connected to a drive motor 70 which is connected to a Proportional Integral Derivative controller or PID controller 72 which is in turn connected to a temperature sensor 74 which senses the temperature of the water in the tank 22. The temperature sensor 74 together with the PID controller 72 is used to control the motor 70 which in turn controls the fan speed of the burner 36. The burner 36 is of the type that draws a vacuum which automatically draws in the gaseous fuel in proportion to the burner air provided by the burner fan (not shown). Thus the control of a single variable, namely fan speed, which is controlled by motor speed, controls the amount of air and the amount of gas passing through the burner and so controls the total BTU output of the burner 36. The motor 70 is for example a DC brushless motor and is controlled by the PID controller 72. HD controllers form a generic control loop with feedback and are widely used in industrial control systems. The PID controller calculates an error value as the difference between measured water temperature and a desired setpoint. The controller attempts to minimize the error by adjusting the motor speed. The MD controller algorithm involves three separate parameters: the proportional, the integral, and the derivative values. The three parameters are tuned to minimize overshoot of the setpoint and system oscillation. It is also possible to provide a factory setting to limit the total BTU output for a given use of the water heater. It may also be desirable to employ an algorithm which minimizes the BTU output consistent with meeting the requirements for hot water output and to thereby maximize the efficiency of the water heater 20 which is more efficient at lower firing rates.

In FIG. 5 the heat exchanging flues 34, 40, 44 are shown schematically and for illustrative purposes are shown arranged sequentially. The theoretical flame temperature for natural gas at 20 to 30% excess air fuel may be taken as about 3000° F. which exceeds the use temperature for most materials so the stainless steel fins 56 are spaced some distance from the burner 36 along the first flue 34 such that in practice the blades do not exceed the continuous use temperature for 309S stainless of about 2000° F. As the gases progress through the heat exchanger, the temperature continues to drop as the gases exchange heat with the water 52 in the tank 22 until the temperature drops to a level where the fins reach a temperature of only 1000° F. and mild steel fins 62 may be used. The maximum temperature experienced by the fins 56 or 62 is dependent on the maximum firing rate (BTUs/hr) of the water heater and so the arrangement of the fins must be selected with the maximum firing rate in mind. Correspondingly, as the firing rate is decreased, the combustion gases 37 cool sooner. Since the temperature of the first junction box 38 is well above the dew point of the combustion gases, the ceramic insulation 39 is located on the inside of the junction box, whereas the second junction box 42 which may see some condensation is insulated externally.

Figure 4:
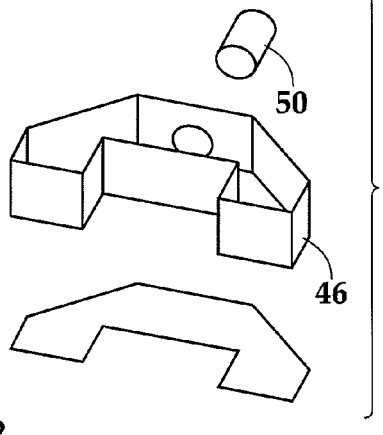
FIG. 4 is an exploded isometric view of the water heater of FIG. 1.

Along the bottom of FIG. 5 are shown the approximate temperatures associated with combustion gas movement through the first, second and third flues. Because the first flue 34 and second flue 40 are constructed of mild steel and are not glass lined it is desirable that combustion gas temperatures exceed the dewpoint of the combustion gases 37 as they travel through the first and second flues. So in addition to the design constraint due to the use maximum temperature associated with the use of 309S stainless, or mild steel fins, there is also a minimum temperature of the gases exiting the second flue. The minimum temperature will control the height to which the fins 62 extend in the second flu 40, which is dependent on the minimum firing rate. Finally, the condensing flues 44 are affected by the firing rate inasmuch as they extract more of the available latent heat value of the steam or water vapor contained in the combustion gases at lower firing rates principally because of the longer time the smaller volume of combustion gases spend within the condensing flues 44. In an exemplary case the dewpoint of the combustion gases may be, for example, 130° F. and the combustion gas temperature entering the second junction box 46 may be 150° F. in order to prevent or limit condensation in the second flue 40. As shown in FIG. 4, a water inlet 76 is arranged at the bottom of the tank 22 and the water outlet 78 is arranged at the top of the tank which is consistent with the hot water naturally rising to the top of the tank. The exit temperature 100° F.-130° F. of the combustion gases 37 is controlled by the temperature of the water 52 within the tank 22, particularly at the bottom of the tank where the cold water inlet 76 is located. When hot water is withdrawn, cold water enters the tank 22 and eventually the burner 36 is turned on in response to the temperature drop sensed by the temperature sensor 74. So when the burner is the cold water is being introduced into the tank bottom to facilitate the functional condensing flues 44. The normal setpoint of the water heater 20 may be 130° F. and yet the exit gases may be cooled below 100° F. by the incoming water which in the mid-latitudes is in the neighborhood of 50-60° F.

How the flues 34, 40, 44 contribute to the overall efficiency is also illustrated in FIG. 5. At a low rate of fire of 183,000 BTUs/hr more of the total heat transfer occurs in the first flue 34, and less in the second flue 40 and third flues 44, compared to a higher rate of fire. Overall a higher efficiency is achieved with lower rates of fire. At high rates of fire such as 500,000 BTUs/hr comparatively more heat transfer takes place in the second flue 40 and third flues 44, but the overall efficiency is lower. In all cases most of the heat transfer occurs in the first flue 34 because the large temperature differential between the combustion gases and the water 52 effects very large heat transfer rates of about 84 to 71 percent of the total available heat corresponding to firing rates of 183,000 BTUs/hr to 500,000 BTUs/hr. The secondary flue 40 transfers between about 4.5 to 11 percent of the total available heat, and the final five parallel flues 44 transfer between about 6.5 and 9 percent of the total available heat. The overall efficiency for the water heater 20 for a 130 gallon tank as illustrated is about 94 percent at a firing rate of 183,000 BTUs/hr and about 91 percent at 500,000 BTUs/hr. The graph at the top of FIG. 5 shows schematically the cumulative heat transfer, and the changing temperature of the combustion gases as the combustion gases pass through each of the flues 34, 40, 44.

Figure 3:
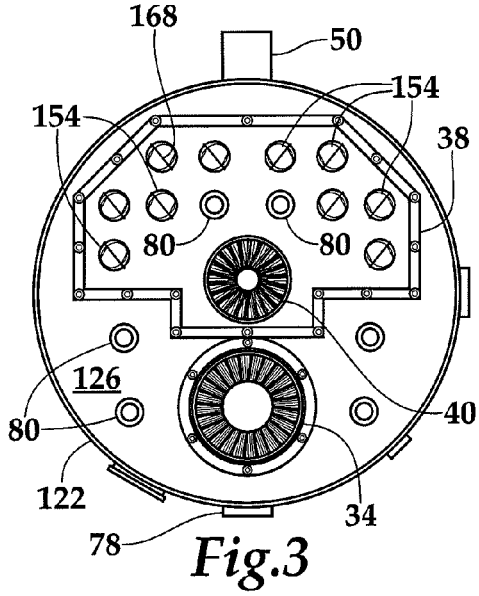
FIG. 3 is a top plan view of an alternative embodiment of the condensing water heater of FIG. 1 showing ten tertiary condensing flues.

Another alternative embodiment water tank 122 is shown in FIG. 3 where, instead of five tertiary flues 54, ten tertiary flues 154 are employed. The tertiary flues 154 are 2 inches in diameter and correspondingly have stainless steel baffles 156 and the tertiary flues are ideally equally distantly spaced from the secondary flue 40, but this ideal need only be approximated as shown in FIG. 3, especially because of the higher flow resistance inherent in the smaller flues 154. The tertiary flues 154 extend to the third junction box 46 in a configuration similar to that shown in FIG. 1. A series of 0.75 NPD Spuds 80 are shown in FIGS. 2 and 3 and are used for insertion of protective anodes, or a pressure release valve.

It should be understood that the 309S stainless steel fins could be constructed of other high temperature metals or alloys. It should also be understood that the stainless steel baffles 68 in the tertiary flues 44 may be of any various designs typically used in the prior art, such as a singular rectangular plate which extends the length of the flue and is twisted into a spiral, or folded into a zigzag, or an arrangement of two rectangular plates which extend the length of the flue and are bent in a triangular wave pattern, wherein the peaks of the triangles are welded together to form a series of open parallelograms. Generally any baffle will work which is arranged to substantially occupy the cross-section of the tertiary flue and cause turbulent mixing of the combustion gases.

The enamel coating used within the condensing flues and also for all surfaces exposed to water within the tank may be for example of the type described in US publication No. US 2003/0082306, published May 1, 2003. This type of porcelain enamel coating is prepared as a water suspension of borosilicate glass, milled silica, and zirconia compounds.

It should be understood that the description of the upper dome 26, and lower dome 28 is intended to include the flat plates illustrated, and other functionally equivalent shapes such as conical, spherical or elliptical or a combination of such shapes whether convex or concave relative to the water tank 22.

It is understood that the invention is not limited to the particular construction and arrangement of parts herein illustrated and described, but embraces all such modified forms thereof as come within the scope of the following claims.

I claim:

1. A water heater comprising:

a water tank having a lower dome and an upper dome, and a tank wall extending therebetween;

a first flue defining a first flue wall, the first flue extending between the upper dome and the lower dome, the first flue joining the upper dome to define an opening through the upper dome, and joining the lower dome to define an opening through the lower dome, the first flue having an inner surface to which a first multiplicity of radially inwardly extending metal fins are attached by a weld, without extending through the first flue wall;

a burner mounted to the first flue so as to fire along the first flue;

a controller connected to the burner to vary the BTU output of the burner;

a second flue defining a second flue wall, the second flue extending along a length between the upper dome and the lower dome and spaced from the first flue, the second flue joining the upper dome to define an opening through the upper dome, and joining the lower dome to define an opening through the lower dome, the second flue having an inner surface to which a second multiplicity of radially inwardly extending metal fins are attached by a weld, without extending through the second flue wall;

a first thermal junction box mounted to one of the upper dome or the lower dome and forming a passageway between the first flue and the second flue, the first junction box opposite the burner so that flue gases pass through the first flue and then pass through the second flue; and wherein the multiplicity of metal fins in the first flue begin at a location spaced downstream from the burner such that the multiplicity of metal fins are exposed to lower temperature, and the multiplicity of metal fins in the first flue extend along the first flue inner surface to the first thermal junction box, and wherein the second multiplicity of metal fins extend along the second flue inner surface.

2. The water heater of claim 1 further comprising:

a plurality of third flues extending between the upper dome and the lower dome and spaced from the first flue and the second flue, the plurality of third flues joining the upper dome to define a plurality of openings through the upper dome, and joining the lower dome to define a plurality of openings through the lower dome;

a second thermal junction box mounted to the upper dome and into which the second flue and the plurality of third flues open so that the second thermal junction box forms a passageway between the second flue and each third flue of the plurality of third flues; and a final junction box mounted to the lower dome and covering the opening through the lower dome defined by the third flues, the final junction box connecting to a condensate drain and a combustion gas exhaust pipe.

3. The water heater of claim 1 wherein the first flue is constructed of mild steel, and the second flue is also constructed of mild steel and wherein at least about one half of the first multiplicity of metal fins in the first flue which are positioned closest to the burner are formed of a first metal with a capacity of continuous use at a first maximum temperature, and the second multiplicity of metal fins in the second flue are formed of a second metal different than the first metal with a capacity of continuous use at a second maximum temperature less than the first maximum temperature.

4. The water heater of claim 3 wherein the first maximum temperature is about 2000° F., and the second maximum temperature is about 1000° F.

5. The water heater of claim 3 wherein the first metal is 309S stainless steel and second metal is mild steel.

6. The water heater of claim 1 wherein the first thermal junction box has an inner lining of insulation.

7. The water heater of claim 2 wherein the plurality of openings through the upper dome defined by the third flues and the opening through the upper dome defined by the second flue within the second thermal junction box are arranged so that the plurality of openings through the upper dome defined by the third flues are substantially equally spaced along an arc of a circle centered on the opening through the upper dome defined by the second flue.

8. The water heater of claim 2 wherein there are at least five and no more than ten third flues, and the third flues are all of the same shape and have a maximum dimension of at least 2 inches and no greater than 5 inches.

9. The water heater of claim 1 wherein each fin of the first multiplicity of metal fins has a generally rectangular plan having two long sides and two short sides and a thickness of about 1/16 to about 5/16 inches and is welded to extend inwardly from the first flue inner surface; and wherein each fin of the second multiplicity of metal fins has a generally rectangular plan having two long sides and two short sides and a thickness of about 1/16 to about 5/16 inches and is welded to extend inwardly from the second flue inner surface.

10. A water heater comprising:

a water tank having a lower dome and an upper dome, and a cylindrical tank wall extending therebetween;

a first cylindrical flue defining a first flue wall, the first cylindrical flue extending between the upper dome and the lower dome, the first cylindrical flue joining the upper dome to define an opening through the upper dome, and joining the lower dome to define an opening through the lower dome, the first cylindrical flue having an inner surface to which a first multiplicity of discrete radially inwardly extending metal fins are attached by a weld, without extending through the first flue wall;

a burner positioned on the upper dome and mounted to fire down the first cylindrical flue toward the opening in the lower dome;

a controller connected to the burner to vary the BTU output of the burner;

a second cylindrical flue defining a second flue wall, the second cylindrical flue extending between the upper dome and the lower dome and spaced from the first cylindrical flue, the second cylindrical flue joining the upper dome to define an opening through the upper dome, and joining the lower dome to define an opening through the lower dome, the second cylindrical flue having an inner surface to which a second multiplicity of discrete radially inwardly extending metal fins are attached by a weld, without extending through the second flue wall;

a first thermal junction box mounted to the lower dome and forming a passageway between the first cylindrical flue and the second cylindrical flue;

a plurality of third cylindrical flues extending between the upper dome and the lower dome and spaced from the first cylindrical flue and the second cylindrical flue, the plurality of third cylindrical flues joining the upper dome to define a plurality of third openings through the upper dome, and joining the lower dome to define a plurality of openings through the lower dome;

a second thermal junction box mounted to the upper dome and into which the second cylindrical flue and the plurality of third cylindrical flues open so that the second thermal junction box forms a passageway between the second cylindrical flue and each third cylindrical flue; and a final junction box mounted to the lower dome and covering the openings through the lower dome defined by the plurality of third cylindrical flues, the final junction box connecting to a condensate drain and a combustion gas exhaust pipe.

11. The water heater of claim 10 wherein the first cylindrical flue is constructed of mild steel, and the second cylindrical flue is also constructed of mild steel and wherein at least about one half of the metal fins in the first cylindrical flue which are positioned downstream of and closest to the burner are formed of a first metal with a capacity of continuous use at a first maximum temperature, and the metal fins in the second flue are formed of a second metal different than the first metal with a capacity of continuous use temperature less than the first maximum temperature.

12. The water heater of claim 11 wherein the first maximum temperature is about 2000° F. and the second maximum temperature is about 1000° F.

13. The water heater of claim 11 wherein the first metal is 309S stainless steel and the second metal is mild steel.

14. The water heater of claim 10 wherein the first thermal junction box has an inner lining of insulation.

15. The water heater of claim 10 wherein the plurality of openings through the upper dome defined by each of the plurality of third cylindrical flues and the opening through the upper dome defined by the second cylindrical flue within the second thermal junction box are arranged so that the plurality of openings through the upper dome defined by the plurality of third cylindrical flues are substantially equally spaced along an arc of a circle centered on the opening through the upper dome defined by the second cylindrical flue.

16. The water heater of claim 10 wherein there are at least five and no more than ten third cylindrical flues, and the third cylindrical flues are all of the same diameter and have a diameter of at least 2 inches and no greater than 5 inches.

17. The water heater of claim 10 wherein each fin of the first multiplicity of metal fins has a generally rectangular plan having two long sides and two short sides and a thickness of about 1/16 to about 5/16 inches and is welded to extend inwardly from the first cylindrical flue inner surface; and wherein each fin of the second multiplicity of metal fins has a generally rectangular plan having two long sides and two short sides and a thickness of about 1/16 to about 5/16 inches and is welded to extend inwardly from the second cylindrical flue inner surface.

18. The water heater of claim 10 wherein the plurality of third cylindrical flues are glass lined and have stainless steel baffles hanging from each of the plurality of third openings through the upper dome, to increase turbulence within the plurality of third cylindrical flues.

19. A water heater comprising:

a water tank having a lower dome and an upper dome, and a cylindrical tank wall extending therebetween;

a first cylindrical flue defining a first flue wall, the first cylindrical flue extending between the upper dome and the lower dome, the first cylindrical flue joining the upper dome to define an opening through the upper dome, and joining the lower dome to define an opening through the lower dome, the first cylindrical flue having an inner diameter to which a first multiplicity of discrete metal fins are attached by a weld, without extending through the first flue wall;

wherein at least some of the discrete metal fins in the first cylindrical flue which are positioned downstream of and closest to the burner are formed of a first metal with a capacity of continuous use at a first maximum temperature;

a burner positioned on the upper dome and mounted to fire down the first cylindrical flue toward the opening in the lower dome;

a second cylindrical flue defining a second flue wall, the second cylindrical flue extending between the upper dome and the lower dome and spaced from the first cylindrical flue, the second cylindrical flue joining the upper dome to define an opening through the upper dome, and joining the lower dome to define an opening through the lower dome, the second cylindrical flue having an inner diameter to which a second multiplicity of discrete metal fins are attached by a weld, without extending through the second flue wall;

wherein at least some of the discrete metal fins in the second flue are of a second metal different than the first metal with a capacity of continuous use at a second maximum temperature lower than the first maximum temperature;

a first thermal junction box mounted to the lower dome and forming a passageway between the first cylindrical flue and the second cylindrical flue;

a plurality of third cylindrical flues extending between the upper dome and the lower dome and spaced from the first cylindrical flue and the second cylindrical flue, the plurality of third cylindrical flues joining the upper dome to define a plurality of openings through the upper dome, and joining the lower dome to define a plurality of openings through the lower dome;

a second thermal junction box mounted to the upper dome and into which the second cylindrical flue and the plurality of third cylindrical flues open so that the second thermal junction box forms a passageway between the second cylindrical flue and each of the plurality of third cylindrical flues; and a final junction box mounted to the lower dome and covering the openings through the lower dome defined by the plurality of third cylindrical flues, the final junction box connecting to a condensate drain and a combustion gas exhaust pipe.

20. The water heater of claim 11 wherein the first maximum temperature is about 2000° F., and the second maximum temperature is about 1000° F.

* * * * *